US008632397B2

(12) United States Patent
Sommer et al.

(10) Patent No.: US 8,632,397 B2
(45) Date of Patent: Jan. 21, 2014

(54) METHOD FOR PLAYER PURCHASING USING FUNDS ASSOCIATED WITH PLAYER ACCOUNTS

(75) Inventors: John Sommer, Reno, NV (US); Walter Eisele, Sparks, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 856 days.

(21) Appl. No.: 12/252,709

(22) Filed: Oct. 16, 2008

(65) Prior Publication Data

US 2010/0099485 A1 Apr. 22, 2010

(51) Int. Cl.
*G07F 17/32* (2006.01)

(52) U.S. Cl.
USPC ..... 463/29; 463/16; 463/20; 463/25; 463/42

(58) Field of Classification Search
USPC ..... 463/16–20, 25, 29
See application file for complete search history.

(56) References Cited

U.S. PATENT DOCUMENTS

| | | | | |
|---|---|---|---|---|
| 4,722,053 | A * | 1/1988 | Dubno et al. | 463/42 |
| 5,770,533 | A * | 6/1998 | Franchi | 463/42 |
| 5,816,918 | A * | 10/1998 | Kelly et al. | 463/16 |
| 2006/0287098 | A1 * | 12/2006 | Morrow et al. | 463/42 |

* cited by examiner

*Primary Examiner* — Omkar Deodhar
(74) *Attorney, Agent, or Firm* — Brooke Quist; Marvin Hein

(57) ABSTRACT

A system and method of providing purchase of gaming and non-gaming services or items while continuing to use a gaming machine. The purchase activity is unrelated to the gambling activities provided by the gaming machine.

7 Claims, 4 Drawing Sheets

METHOD FOR PLAYER PURCHASING USING FUNDS ASSOCIATED WITH PLAYER ACCOUNTS

CROSS-REFERENCE TO RELATED APPLICATIONS

This application is related to co-pending U.S. patent application Ser. No. 12/252,633, filed Oct. 16, 2008.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates generally to a gaming system that facilitates continued play, and more particularly, to a system and methodology that permits player purchasing using funds associated with the players' accounts.

BACKGROUND

Traditionally, gaming machines have been designed for gaming purposes only. In this regard, gaming machines have been constructed only to include gaming functionality. Recently, however, casino owners have become aware that by adding additional features to gaming machines, they may be able to maintain a player's attention to the gaming machines for longer periods of time. This, in turn, leads to the player wagering at the gaming machine for longer periods of time, thereby increasing casino profits.

One technique that has been employed to maintain a player's attention at the gaming machine has been to provide players with access to gambling-related information. By attaching a small electronic display to the gaming device, gambling-related information, as well as news and advertisements can be sent to the player. The gambling-related information may include, for example, information on sports betting and betting options for those sporting events. Additionally, the gambling-related information may also include information such as horse racing and off-track betting. News and advertisements can also maintain a player's attention by providing the player with access to information ranging from show times, to restaurant and hotel specials, and to world events, thus reducing the need and/or desire for the player to leave the gaming machine.

It has been found that greater levels of flexibility in gambling activities and access are likely to make a player remain and gamble at the gaming machine for significantly longer periods of time. Thus, efforts have been made to make the system components, such as external keypads and display modules, to provide the functionality and capabilities that tend to maintain a player's attention.

Casino profits can also be optimized by devising other approaches to facilitate continued gambling at a machine. While gambling at a machine, a player may develop a need for food or may wish to play other games or engage in other gambling activities unrelated to the game at hand. The player may also wish to plan future activities or purchase items such as gifts or hotel stays without wanting to leave the gambling machine.

Accordingly, there is a need for a system that is capable of continued play while permitting partial credit or winnings to be cashed out for use in purchasing various items. The present disclosure addresses these and other needs.

SUMMARY

Briefly, and in general terms, the present disclosure addresses the above and other issues by providing an user interface for use in a gaming machine configured with the ability to engage in activity unrelated to the gambling provided by a particular gaming machine. In one particular approach, a gaming device can project one or more itemized menus for purchasing items—both gaming and non-gaming related. Thus, the number of services a casino can provide a player can be greatly expanded thereby enhancing the player experience. These players then tend to spend more time playing in the casino. In one embodiment, the purchasing feature is embodied in a gaming device. An iView, GTM, GMN, browser, kiosk or other gaming device or feature thereof is configured to display a list of items a player can purchase. Accounts of player cards can be used to make the purchases.

In a contemplated method, a player selects an item for purchase and a method of payment such as using a casino account or a credit/debit card issued from a financial institution. The interfacing device (i.e., iView) then calls a web service requesting the purchase of the item along with payment. The funds would then be temporarily deducted from the account shown and a request for purchase is made to the casino, such as through a casino's online purchasing application. Upon confirmation of the purchase, funds are then deducted from the player's account.

Various items are contemplated to be provided for purchase in connection with this system and method. Accordingly, one or more of food, keno, continuous play games, sports betting, upcoming events, gift shop items and extended hotel stays can be purchased while playing at a gaming machine embodying the present disclosure. Other services and items are also contemplated for purchase employing the disclosed approach.

Other features and advantages of the present disclosure will become apparent from the following detailed description when taken in conjunction with the accompanying drawings, which illustrate by way of example, the features of the disclosure.

DETAILED DESCRIPTION

The present disclosure is directed towards a gaming system and method which permits activities unrelated to a particular game of a gaming device. In particular, the gaming device is contemplated to provide an itemized menu for purchasing both gaming and non-gaming items.

In general, a Bally iView product, a GTM (gaming transaction manager), a GMU (gaming monitoring unit), a browser, a kiosk or other gaming device can be configured to display a list of items a player could purchase from one or more menus using accounts established by the player. Funds are temporarily deducted from a chosen account and the purchase request can be made; for example, to a casino's online purchasing application. Once a purchase is confirmed, funds are deducted from a player's account. Items can also be purchased using a players' debit or credit card. In this way, the types of services a casino can provide to a player can be innumerable, thus enhancing a player's experience.

Figure 1:
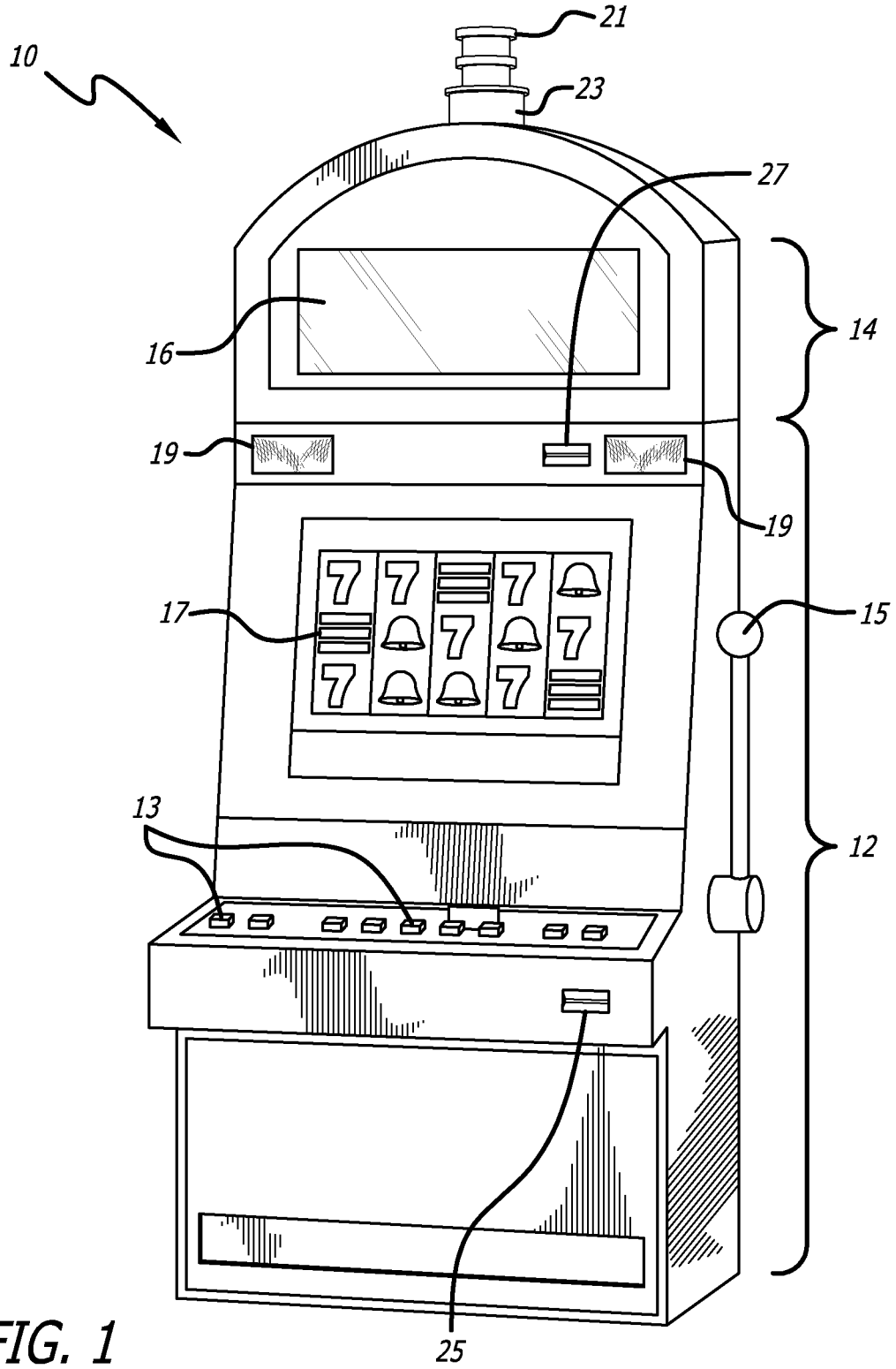
FIG. 1 is a perspective view of one embodiment of a gaming device.
Figure 2:
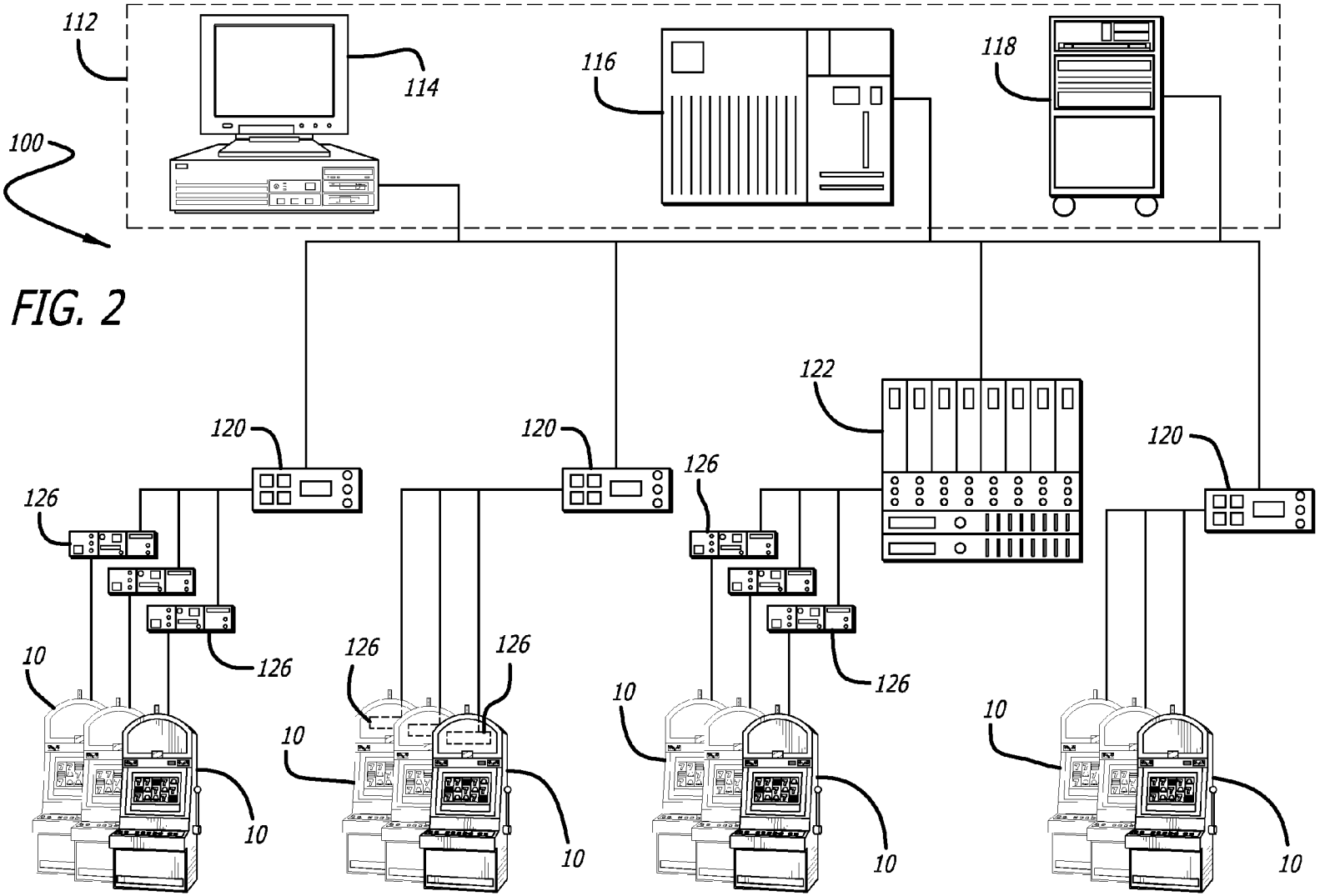
FIG. 2 is a diagram of one embodiment of a gaming system including one or more gaming machines.

Referring now to the drawings, wherein like reference numerals denote like or corresponding parts throughout the drawings and, more particularly to FIGS. 1 and 2, there are shown various embodiments of a reel based gaming machine which is presented as an example of an approach which can be configured to include the ability to purchase unrelated gaming and non-gaming items. More specifically, as shown in FIG. 1, the gaming machine 10 includes a main cabinet 12 and a top box 14. The gaming machine also includes various player input devices 13, 15 to play one or more games presented on a main display 17.

Referring back to FIG. 1, the main cabinet 12 of the gaming machine 10 is a self-standing unit that is generally rectangular in shape. Alternatively, in other embodiments, the gaming cabinet may be a slant-top gaming cabinet or any shaped cabinet known or developed in the art. Additionally, the cabinet may be manufactured with reinforced steel or other rigid materials that are resistant to tampering and vandalism. Optionally, in an alternate embodiment, the gaming machine 10 may instead be a cinema-style gaming machine (not shown) having a widescreen display.

As shown in FIG. 1, the gaming device 10 includes a main display 17. According to one embodiment, the main display 17 is a plurality of mechanical reels for presenting a slot-style game. Alternatively, the main display 17 is a video display for presenting one or more games such as, but not limited to, mechanical slots, video slots, video keno, video poker, video blackjack, video roulette, Class II bingo, games of skill, games of chance involving some player skill, or any combination thereof.

According to yet another embodiment, the main display 17 is a widescreen display (e.g., 16:9 or 16:10 aspect ratio display). In one embodiment, the display 17 is a flat panel display including by way of example only, and not by way of limitation, liquid crystal, plasma, electroluminescent, vacuum fluorescent, field emission, LCOS (liquid crystal on silicon), and SXRD (Silicon Xtal Reflective display), or any other type of panel display known or developed in the art. These flat panel displays may use panel technologies to provide digital quality images including by way of example only, and not by way of limitation, EDTV, HDTV, or DLP (Digital Light Processing). The widescreen display 17 may be mounted in the gaming cabinet 12 in a portrait or landscape orientation. In another embodiment, the game display 17 may also include a touch screen or touch glass system (not shown). The touch screen system allows a player to input choices without using any electromechanical buttons 13. Alternatively, the touch screen system may be a supplement to the electromechanical buttons 13.

According to one embodiment, the top box 14 is a separate and distinct component that is affixed to the main cabinet 12. In another embodiment, the top box 14 is an area that is partitioned from the main cabinet 12. Alternatively, the top box 14 and the main cabinet 12 may be contiguous areas with the outward appearance of two distinct components. According to one embodiment, the top box 14 includes a display glass. The display glass may include the name of the game, artwork, game instructions, pay table, or other information relating to the game.

According to another embodiment, the top box 14 includes a secondary display for displaying game information (e.g., name of the game, game marquee, animation, one or more pay tables, game information, one or more help menus, one or more secondary games, progressive jackpot information or tournament game information) or non-game related information (e.g., news, advertisements, messages or promotions). The secondary display 16 may be a flat panel display, dot matrix display, cathode ray tube display, display glass, backlit display glass, diorama, three-dimensional relief, pachinko-style secondary game, one or more wheels, one or more mechanical reels, or a combination thereof. The display 16 may have a wide screen aspect ratio (4:3, 16:9, 16:10 or the like) and the display may or may not include a touch screen or other touch device associated therewith. Optionally, the secondary display is movable (e.g., tilted a few degrees downward or upward) so that the display is more easily viewed by a casino patron. The movement of the display may be done manually or automatically (e.g., motor or linear actuator).

Additionally, as shown in FIG. 1, the top box 14 includes a candle 21 having three tiers. As those skilled in the art will appreciate, other embodiments of the candle 21 may include one or more tiers. The tiers may be jointly or individually illuminated with one or more incandescent light bulbs or light emitting diodes (LEDs). In one embodiment, the bottom tier 23 of the candle 21 includes a plurality of multi-colored LEDs. Additionally, a plurality of LED reflectors (not shown) are provided within the bottom tier 23 of the candle 21. For example, in one embodiment, eight reflectors are provided within the bottom tier in a octagonal configuration (when viewed from above). Accordingly, the LEDs in the bottom tier 23 of the candle 21 may be alternately illuminated (in the same or different colors) around the circumference of the bottom tier to simulate a rotating light. Alternatively, the LEDs may flash in one or more colors. Accordingly, the LEDs in the bottom tier 23 of the candle 21 may be programmed to illuminate when a jackpot is triggered. The lights in the top tiers of the candle 21 may be illuminated to signal that a player needs assistance from a casino floor employee, a jackpot has been won, or that a responsible gaming message has been presented to a player.

As shown in FIG. 1, the gaming device 10 includes a plurality of player-activated buttons 13. These buttons 13 may be used for various functions such as, but not limited to, selecting a wager denomination, selecting a number of games to be played, selecting the wager amount per game, initiating a game, or cashing out money from the gaming machine 10. The buttons 13 function as input mechanisms and may include mechanical buttons, electromechanical buttons or touch screen buttons. In another embodiment, one input mechanism is a universal button module that provides a dynamic button system adaptable for use with various games. Additionally, other input devices, such as but not limited to, touch pad, track ball, mouse, switches, toggle switches, are included with the gaming machine to also accept player input. Optionally, a handle 15 may be "pulled" by a player to initiate a slots-based game.

In an alternate embodiment, a cellular phone or other input device (e.g., PDA), separate and apart, from the gaming machine 10 may also be used to input various player choices and information to enhance the player's interactive experience with the gaming machine. Furthermore, inputting information via these devices provides an added level of security as any key presses may be hidden from view. In yet another embodiment, a player may call or send a text message or a short message service (SMS) to the gaming machine.

As shown in FIG. 1, the gaming device 10 includes a ticket reader/ticket printer slot 25 that is associated with a cashless gaming system (not shown). As shown in FIG. 1, a single slot 25 is used for the ticket reader and ticket printer. Accordingly, the same slot 25 may be used to insert and/or issue a ticket. However, in alternate embodiments, separate slots (not shown) may be provided for the ticket acceptor and the ticket printer. In one embodiment, the ticket reader (not shown) of the cashless gaming system is capable of accepting previously printed vouchers, paper currency, promotional coupons, or the like. The ticket printer (not shown) of the cashless gaming system generates vouchers having printed information that includes, but is not limited to, the value of the voucher (i.e., cash-out amount) and a barcode that identifies the voucher. In yet another embodiment, the ticket printer generates tax receipts for charitable donations made on the responsible gaming machine.

Additionally, the gaming device includes a player tracking system (not shown). The player tracking system allows a casino to monitor the gaming activities of various players. Additionally, the player tracking system is able to store data relating to a player's gaming habits. That is, a player can accrue player points that depend upon the amount and frequency of their wagers. Casinos can use these player points to compensate the loyal patronage of players. For example, casinos may award or "comp" a player free meals, room accommodations, tickets to shows, and invitations to casino events and promotional affairs.

Typically, the player tracking system is operatively connected to one or more input components on the gaming machine 10. These input components include, but are not limited to, a slot 27 for receiving a player tracking card, a keypad or equivalent, an electronic button receptor, a touch screen and the like. The player tracking system may also include a database of all qualified players (i.e., those players who have enrolled in a player rating or point accruing program). Generally, the database for the player tracking system is separate from the gaming devices.

In another embodiment, the gaming device 10 includes an internet connection or other known network connections to link one or more gaming devices together. According to one embodiment, the internet connection is used for web browsing, prize redemption, or access to other gaming or non-gaming information. Additionally, with the various gaming devices in communication with one another (or a system host), the gaming device 10 may participate in a gaming tournament. In one embodiment, the gaming tournament is a competitive gaming tournament having one (or a few) winners. Alternatively, the gaming tournament is a cooperative gaming tournament where all eligible gaming devices win a particular award.

One of ordinary skill in the art will appreciate that not all gaming devices have all these components and that the gaming devices may have other components in addition to, or in lieu of, those components mentioned here. Furthermore, while these components are viewed and described separately, various components may be integrated into a single unit in some embodiments.

Referring now to FIG. 2, a casino gaming system 100 is illustrated. The casino gaming system 100 comprises one or more gaming devices 10. In various embodiments, any of the gaming devices 10 may be any type of electronic or mechanical gaming devices, such as, but not limited to, a mechanical reel spinning slot machine, video slot machine, video poker machine, keno machine, video blackjack machine, or a gaming machine offering one or more of the above-described games. Examples include, but are not limited to, the S6000 mechanical reel spinner and the Alpha video slot machine from Bally Technologies, Inc. The gaming devices 10, 20 illustrated in FIG. 2 act as terminals for interacting with a player playing a casino game. Networking components facilitate communications between the system server 112 and game management units 126 that control displays for carousels of gaming devices 10 across a network 740. Game management units (GMU's) 126 connect gaming devices to networking components and may be installed in the gaming machine cabinet or external to the gaming machine 10. The function of the GMU 126 is similar to the function of a network interface card connected to a desktop personal computer (PC). Some GMU's 126 have much greater capability and can perform such tasks as presenting and playing a game using a display (not shown) operatively connected to the GMU 126. In one embodiment, the GMU 126 is a separate component located outside the gaming machine 10. Alternatively, in another embodiment, the GMU 126 is located within the gaming machine 10. Optionally, in an alternative embodiment, one or more gaming devices 10 connect directly to a network and are not connected to a GMU 126.

Furthermore, one or more of the gaming devices 10 includes one or more data repositories for storing data. Examples of information stored by the gaming devices 10 include, but are not limited to, accounting data, maintenance history information, short and/or long-term play data, real-time play data, and sound data. The sound data may include, but is not limited to, audio files, sound clips, wav files, mp3 files and sound files saved in various other formats. Furthermore, each gaming machine 10 comprises an audio system (not shown) for outputting sound.

The gaming devices 10 are connected via a network to a network bridge 120, which is used for networking, routing and polling gaming devices, including slot machines. The network bridge 120 connects to a back end system 112. Optionally, the gaming devices 10 may connect to the network via a network rack 122, which provides for a few number of connections to the back end system 112. Both network bridge 120 and network rack 122 may be classified as middleware, and facilitate communications between the back end system 112 and the game management units 126. The network bridges 120 and network rack 122 may comprise data repositories for storing network performance data. Such performance data may be based on network traffic and other network related information. Optionally, the network bridge 120 and the network rack 122 may be interchangeable components. For example, in one embodiment, a casino gaming system may comprise only network bridges and no network racks. Alternatively, in another embodiment, a casino gaming system may comprise only network racks and no network bridges. Additionally, in an alternative embodiment, a casino gaming system may comprise any combination of one or more network bridges and one or more network racks.

The back end system 112 may be configured to comprise one or more servers. The type of server employed is generally determined by the platform and software requirements of the gaming system. In one embodiment, the back end system 112 is configured to include three servers: a slot floor controller 114, a casino management server 116 and a casino database 118. The slot floor controller 114 is a part of the player tracking system for gathering accounting, security and player specific information. The casino management server 116 and casino database 118 work together to store and process information specific to both employees and players. Player specific information includes, but is not limited to, passwords, biometric identification, player card identification, and biographic data. Additionally, employee specification information may include biographic data, biometric information, job level and rank, passwords, authorization codes and security clearance levels.

Overall, the back end system 112 performs several fundamental functions. For example, the back end system 112 can collect data from the slot floor as communicated to it from other network components, and maintain the collected data in its database. The back end system 112 may use slot floor data to generate a report used in casino operation functions. Examples of such reports include, but are not limited to, accounting reports, security reports, and usage reports. The back end system 112 may also pass data to another server for other functions. Alternatively, the back end system 112 may pass data stored on its database to floor hardware for interaction with a game or game player. For example, data such as a game player's name or the amount of a ticket being redeemed at a game may be passed to the floor hardware. Additionally, the back end system 112 may comprise one or more data repositories for storing data. Examples of types of data stored in the system server data repositories include, but are not limited to, information relating to individual player play data, individual game accounting data, gaming machine accounting data, cashable ticket data, and sound data including optimum audio outputs for various casino settings.

Of course, one will appreciate that a gaming system 100 may also comprise other types of components, and the above illustrations are meant only as examples and not as limitations to the types of components or games used in a casino gaming system capable of presenting a responsible gaming message.

The main cabinet 14 of the gaming machine houses a game monitoring unit (not shown) that includes a CPU, circuitry, and software for receiving signals from the player-activated buttons 13 and/or a handle 15, operating the games, and transmitting signals to the respective game display 17 and speakers 19. The game monitoring unit is a device that is connected to the circuitry of the gaming machine that monitors the game, coin status, player winnings, and other functions of the gaming machine. The game monitoring unit also sends the monitored information to a backend server for processing.

In various embodiments, the game program may be stored in a memory (not shown) comprising a read only memory (ROM), volatile or non-volatile random access memory (RAM), a hard drive or flash memory device or any of several alternative types of single or multiple memory devices or structures.

Figure 3:
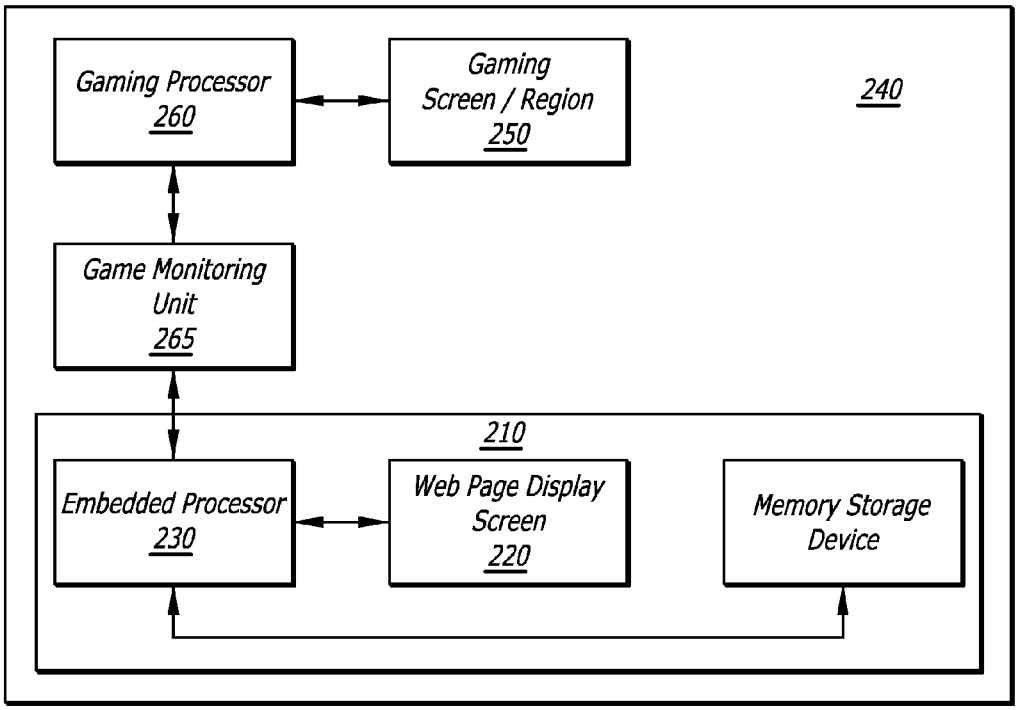
FIG. 3 illustrates a relational diagram of an embedded additional user interface utilizing a web page display screen and an embedded processor that receives data messages from a game monitoring unit that are translated into web page content and mapped to the web page display screen.

Turning now to FIG. 3, there is shown one embodiment of an embedded additional user interface 210 that can be incorporated into the gaming machine 100. Specifically, FIG. 3 shows an embedded additional user interface 210 that includes a web page display screen 220 and an embedded processor 230. The user interface 210 is incorporated into a gaming machine 240 that, in turn, includes a gaming screen 250, (and/or non-screen gaming region 250, e.g., spinning reels or other gaming presentation) gaming processor 260, and a game monitoring unit or a game transaction manager 265. The embedded processor 230 employs an internal operating system and communicates with the gaming processor 260. The embedded processor 230 reads incoming data, translates the data into a web authoring language, and maps the data to the web page display screen 220. The display screen 220 presents web page information to a user via the display screen, thereby increasing user excitement by providing a richer gaming experience. The game monitoring unit 265 monitors the information that is input through the user interface 210. The user interface 210 communicates with the game monitoring unit or game transaction manager 265. Thus, the game monitoring unit or game transaction manager can use content to define soft keys to provide a menu for purchasing items, both gaming and non-gaming, which are unrelated to the gambling activity of the gaming device.

Figure 4:
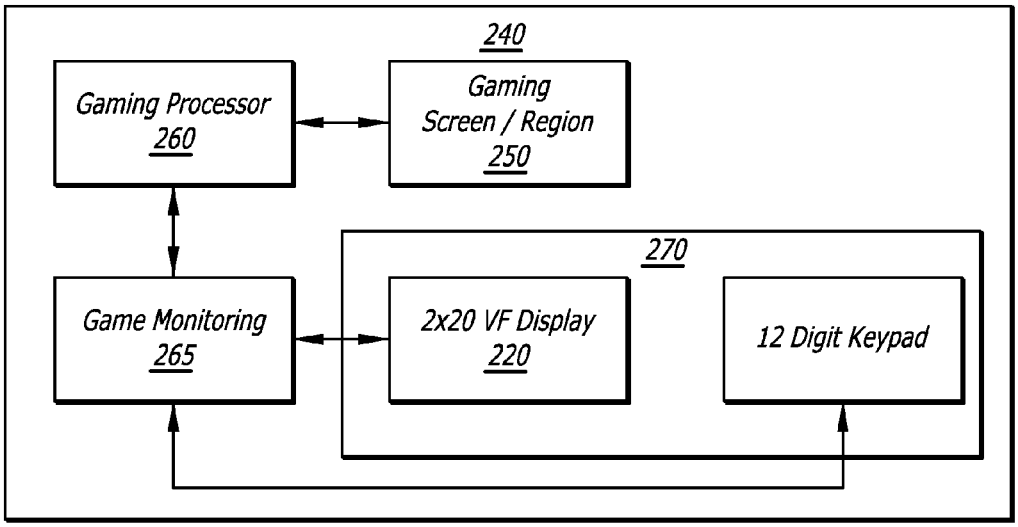
FIG. 4 illustrates a relational diagram of another approach to a gaming system.

As shown in FIG. 4, an alternate approach to a gaming machine can include a single video display screen as a gaming screen 250 for the gaming machine 240, while additional system components 270 were attached or juxtapositioned next to the gaming machine. In this approach, the gaming screen 250 of the electronic gaming machine can include an additional set of touch screen buttons which effectuates the purchase of unrelated gaming and non-gaming activities.

Referring again to FIG. 3, in situations involving multiple gaming machine (or gaming component) manufactures, an embedded additional user interface 210 can be incorporated into a gaming machine (either originally or by retrofitting) without requiring access to the game logic or other gaming systems that might be proprietary and inaccessible with a gaming machine from another gaming manufacturer. Thus, in a preferred embodiment of the claimed invention, the embedded additional user interface 210, which includes a web page display screen 220 for presenting supplementary information to a player, is incorporated into a gaming machine 240 in addition to the standard gaming screen 250 typically found in a gaming machine. The embedded additional user interface 210 may also be incorporated into a gaming machine 240 that utilizes a gaming region (e.g., a reel-spinner) instead of a standard gaming screen 250. This supplemental information may include general gaming information, player specific information, player excitement and interest captivation content, advertising content (targeted or otherwise), and the like. Further, in other preferred embodiments, the embedded additional user interface 210 may have the ability to interact with the game logic of the gaming processor 260, and thus, provide further functionality, such as bonus games and/or the ability to incorporate awards, promotional offers, or gifts from the web page display screen 220 to the gaming screen 250. Moreover, the web page display screen 220 may display supplemental information in an "attract mode" when there is no game play occurring.

In an embodiment of the disclosure, the embedded additional user interface 210 is used to make casino services more accessible and friendly to casino patrons such as by providing the ability to purchase food, gift shop items, hotel stays or to engage in unrelated gambling activities such as sports betting and Keno. In one embodiment, the embedded additional user interface 210 is designed to interface with the hardware configuration of game platforms currently employed in an existing gaming communication systems network, thus decreasing implementation costs for the casino. A standard gaming network interface to the systems network, such as a Mastercom system, includes a multi-drop bus method of communicating to a keypad and display. The Mastercom system is available from Bally Manufacturing, and is described in U.S. Pat. No. 5,429,361 to Raven et al. incorporated herein by reference. One such currently utilized bus is an EPI bus (Enhanced Player Interface bus), which uses industry standard I.sup.2C hardware and signalling. Moreover, further details of a user interface system for a gaming machine can be found in co-pending U.S. application Ser. No. 10/943,771, the contents of which are incorporated by reference.

Accordingly, using the above-described system and method one or more unrelated gaming or non-gaming services or items can be purchased while gambling at a gaming machine. For example, using a player card account or a debit/credit card, food can be purchased while at a gaming machine. That is, a "hot" player may not want to leave their machine and might be hungry. The player would be able to order a sandwich and have it served to them at the machine, needing only to sign a receipt. Also, most casinos have casino-wide keno games which run around the clock. It would be more cost-effective if players at slot machine could select cards for the next keno drawing using an automated function. A receipt can be printed at the game identifying the selected cards and cost.

Additionally, many games being developed continue play by allowing the player to buy a "bonus" round or game. If the player is out of credits on the machine, this function could allow the purchase of that game using one of the player's accounts. Moreover, bets on current sporting events using the current ODDS provided by the casino Sports Book can be made using the presently described approaches. The content displayed on the iView/GTM also could be an "advertisement" for an upcoming event. The player could then purchase tickets for this event while playing. The casino could further promote a discount for seating by player card members when using this feature.

Everything available at a gift shop could be purchased with an option of picking up the items at the gift shop or having the items delivered to the player while they are playing (limited to small items purchased) through itemized menus provided by this system. Extended-stay hotel packages either adding additional days to their current trip or reserving rooms for a future return trip can also be purchased from a gaming machine incorporating this system.

As stated, the applications for communicating the purchase messages between the device and a banking entity (with a connection to a financial transaction processor) would already be in place. The only required set of code would be an application to take the purchase request and interface with the appropriate purchasing application, POS system, etc.

Figure 5:
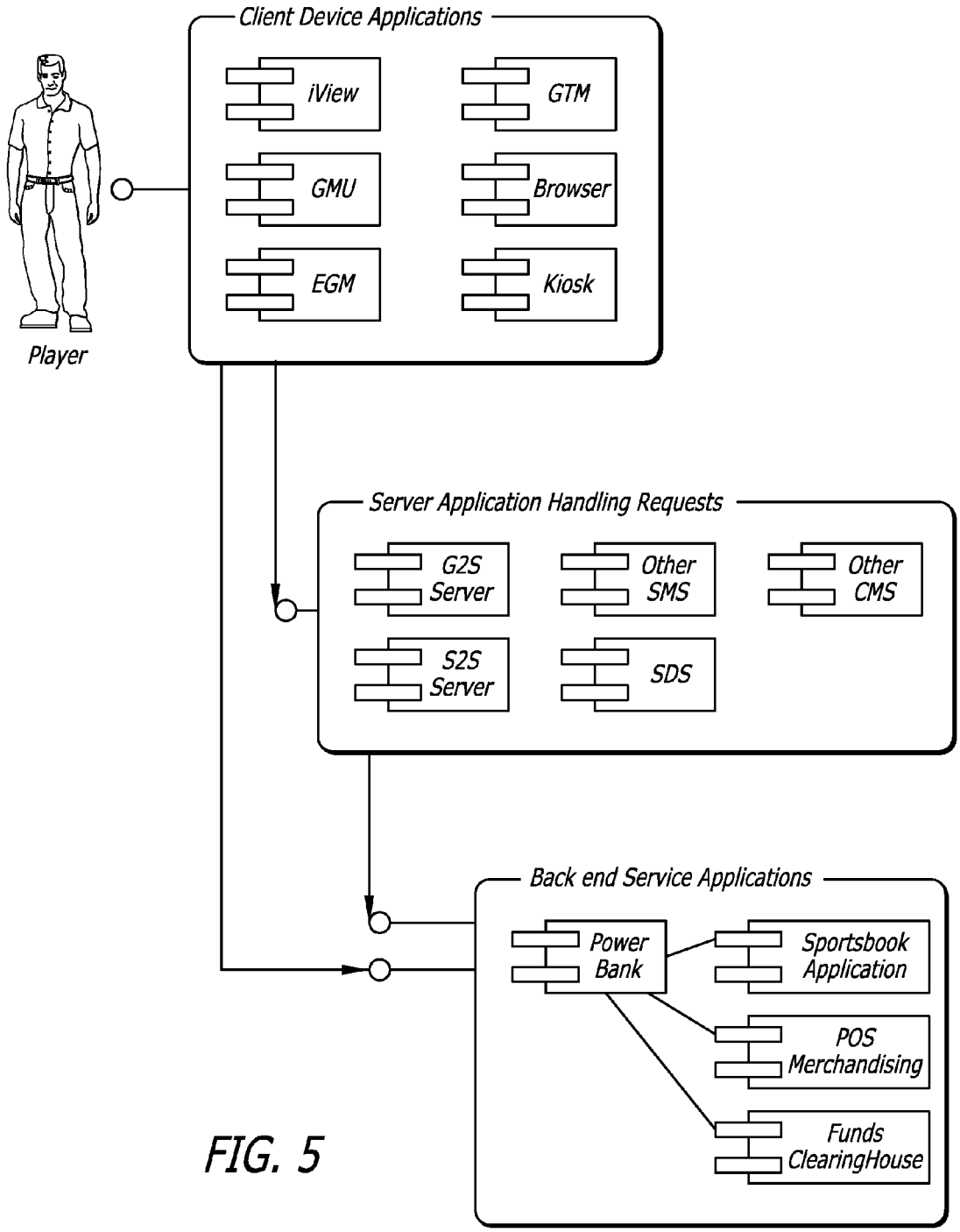
FIG. 5 is a diagram illustrating a three-tiered representation of an example system.

FIG. 5 illustrates a 3-tiered representation of an example system where the first tier are applications the user can interact with. The second tier shows some of the Server applications that directly deal with the gaming devices on the floor. The third tier represents function-specific bank-end applications that deal with funds transfers, POS, and purchasing applications. Thus, a player can make desired gaming and non-gaming purchases unrelated to the gambling activities provided by the particular gaming devices he or she is using. Such a player's gambling experience is thereby enhanced and extended to the benefit of the casino.

It is to be recognized that the various embodiments described above are provided by way of illustration only and should not be construed to limit the invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A method of providing player purchasing, comprising:

engaging in gambling activity on a gaming device;

providing an embedded additional user interface which includes an embedded processor;

activating the embedded additional user interface to perform independently from gaming logic for the gaming device;

placing the gaming device in communication with a web service to enable communication with a casino online purchasing application for purchase of an item using funds from a player account;

enabling at the user interface the selecting of an item for purchase from an itemized menu provided on the gaming device, wherein such selection is made independent of the gambling activity, wherein selecting an item for monetary purchase is made simultaneous with the gambling activity.

2. The method of claim 1, further comprising configuring the menu to include non-gaming items.

3. The method of claim 1, further comprising configuring the menu to include gaming items unrelated to the gaming device gambling activity.

4. The method of claim 1, wherein the embedded additional user interface includes an attract mode and further including activating the attract mode.

5. The method of claim 1, further comprising making a purchase through the casino online purchasing application.

6. The method of claim 1, further comprising activating the embedded additional user interface to perform independently from gaming logic for the gaming device.

7. The method of claim 1, further comprising delivering the purchased item to the player at the gaming device.

* * * * *

UNITED STATES PATENT AND TRADEMARK OFFICE

CERTIFICATE OF CORRECTION

PATENT NO. : 8,632,397 B2
APPLICATION NO. : 12/252709
DATED : January 21, 2014
INVENTOR(S) : John Sommer and Walter Eisele It is certified that error appears in the above-identified patent and that said Letters Patent is hereby corrected as shown below:

In the Specification

Column 2, In line 12, replace “an” with --a--

Column 6, In line 13, delete “740” after “network”

Signed and Sealed this
Twenty-ninth Day of April, 2014

Michelle K. Lee

Michelle K. Lee
*Deputy Director of the United States Patent and Trademark Office*